United States Patent [19]

Fels et al.

[11] Patent Number: 4,715,612

[45] Date of Patent: Dec. 29, 1987

[54] ALPINE SKI

[76] Inventors: Christopher Fels, 32-655 Richmond Road, Ottawa, Ontario K2A 3Y3, Canada; David Fels, 317 Chapel Street, Ottawa, Ontario K1N 7Z2, Canada

[21] Appl. No.: 804,836

[22] Filed: Dec. 4, 1985

[30] Foreign Application Priority Data

Jun. 28, 1985 [CA] Canada ..... 485027

[51] Int. Cl.[4] ..... A63C 5/04

[52] U.S. Cl. ..... 280/609

[58] Field of Search ..... 280/602, 609, 610, 606, 280/608

[56] References Cited

U.S. PATENT DOCUMENTS

| | | | |
|---|---|---|---|
| 2,258,046 | 10/1941 | Clement | 280/602 |
| 2,510,794 | 6/1950 | Beerli | 280/609 |
| 3,926,451 | 12/1975 | Guild | 280/609 |
| 4,085,947 | 4/1978 | Sarver | 280/609 |
| 4,340,241 | 7/1982 | Crocket | 280/609 |
| 4,377,297 | 3/1983 | Staufer | 280/609 |
| 4,487,426 | 12/1984 | Nishizawa | 280/609 |

FOREIGN PATENT DOCUMENTS

| | | |
|---|---|---|
| 173373 | 12/1952 | Austria . |
| 643186 | 3/1937 | Fed. Rep. of Germany . |

*Primary Examiner*—David M. Mitchell
*Assistant Examiner*—Richard Camby
*Attorney, Agent, or Firm*—Birch, Stewart, Kolasch & Birch

[57] ABSTRACT

There is provided a new and useful ski, particularly an Alpine ski, where the maximum height (radius of curvature) of the bottom camber is in the rearward portion of the ski behind the centerline of the boot placement; and the waist (minimum width of side camber) of the ski is ahead of the centerline of the boot placement such that the ski width is increasing at this centerline position.

8 Claims, 4 Drawing Figures

ALPINE SKI

BACKGROUND OF THE INVENTION

This invention relates to an improved ski design and more particularly to an improvement in the efficiency of Downhill skis, Giant Slalom skis, Slalom skis and Recreational Alpine skis.

The present ski design has developed over the years. The two key factors which affect the performance of a ski are the "camber" which is the upwardly bowed bottom surface and the "side camber" or "side cut" in which the forward end and rear end of the ski are wider then the center or waist of the ski.

Clement, U.S. Pat. No. 2,258,046 issued Oct. 7, 1941 illustrates an early ski which incorporates camber. Beerli in U.S. Pat. No. 2,210,794 issued June 6, 1950 illustates th concept of "side camber".

Unfortunately snow conditions and ski terrain are not uniform and vary dramatically. Thus skis are required to perform on conditions ranging from ice, hard packed powder, powder, corn snow, broken crust, etc. Skiing is also a difficult learned skill in which the ability of the skier is an important factor.

There have been many modifications to the design of skis over the years to improve their performance. Most of these have been within the state of the art while other more novel designs have been patented.

Some examples of the former are:

1. The design of the side camber (side cut) has been varied to optimize the turning radius of the ski. The designs are noticeably different in some downhill and slalom skis.

2. The placement of the boot has been moved forward and/or backward from the usual position on the ski.

3. The stiffness of the ski has been varied not only of the entire ski but also to have different degrees of stiffness between the forward portion of the ski and the rearward portion of the ski.

4. The degree of curvature and height of the "camber" (upward bowed bottom surface) have also been modified usually in relation to the stiffness and length of the ski.

Some examples of the latter are:

1. U.S. Pat. No. 4,377,297 which describes an alpine ski with a special modified side cut which has a bulge under the boot area to apply more edge pressure at this point of the ski during a turn.

2. Other patents showing variation in side cut are Austrian Patent No. 173,373 and German Patent 643,186.

3. Canadian Pat. No. 1,148,680 is for a reverse camber (bottom bowed) ski which is suited for beginner skiers as it is easier to turn.

4. U.S. Pat. No. 4,487,426 describes a ski with a reverse or relatively no camber combined with a convex or modified convex side camber.

5. A number of novel ski designs have been developed such as U.S. Pat. No. 4,085,947 which describes a rearward controlled snow ski which is basically a short ski with the rearward position of the ski (behind boot) being 20% of the ski length.

Another significant factor to improve the capabilities of the skier and thus the performance of the skis has been the "forward lean" built into the ski boot. This has allowed the skier to shift his weight as required during turns while making it easier (due to the cantilever effect) to maintain his position relative to the fall line of the ski slope. Unfortunately standing on skis with this boot on level ground or walking causes discomfort to the skier.

The sport of skiing requires a high degree of skill from the participant. To control the skis and their direction and maintain balance on a wide range of snow conditions the skier must shift his weight in many directions, apply edging and apply other forces to his skis which appropriately apply them to the ground (ski slope). As it is only through the skis that the desired forces can be applied, the ski design is critical to the sport.

BRIEF SUMMARY OF THE INVENTION

It is an object of the invention to provide a new alpine ski design which enhances the ability of a skier to control speed and turns and to maintain stability.

It is a further object of the invention to improve the efficiency of alpine skis.

In furtherance of these objects, the invention provides a ski, particularly an Alpine ski, where the maximum height (radius of curvature) of the bottom camber is in the rearward portion of the ski behind the centerline of the boot placement; and the waist (minimum width of the side camber) of the ski is ahead of the centerline of the boot placement such that the ski width is increasing at this centerline position. These two disclosures in combination result in a ski which is much more controllable in turns on all snow conditions usually encountered on ski slopes.

GENERAL DESCRIPTION

This invention is a major improvement in ski design to meet the requirements of the skier to control his turns and speed and maintain his stability.

This ski design also assists the skier in overcoming the forces acting against him such as gravity and angular forces created during the turns.

To initiate a turn a skier must turn the skis at an angle to his current direction. This is accomplished by an up unweighting and by turning the feet at the point in time when the skis have the least downward pressure on them. As the pressure increases upon the skis they begin to bend and due to the concave sidecut move in an arc in the direction of the turn.

Very quickly the ski achieves the amount of pressure required for the ski to bend to the desired arc of the turn. As the skier continues to turn, the pressure on his skis increases dramatically, due to the angular force plus pull of gravity as the skier cuts across the fall line. In order for the skis to retain their grip it is necessary to absorb a great deal of the increasing pressure (energy). This is accomplished in two ways:

1. The skier himself can bend lower and lower to absorb the energy.

2. The skis can bend more and more storing the increasing pressure.

As we have noted, the skis achieve the arc of the turn in the very early stages. Therefore in order for the ski to bend more the skier must either put more weight on the front or back of the skis.

Placing more weight on the front portion would cause the skis to plow the snow and would cause the skis to have a greater curvature than the desired radius of the turn.

It is necessary then to apply the increasing pressure towards the tail of the skis.

This does not cause the skis to overturn because from just in front of the boot to the back of the ski has very little sidecut (in and by itself) so that the further back the weight becomes, the more increased bend the tail of the skis must acquire to retain the curve of the turn. Therefore by pressuring the tails of the skis (or by letting the tail of the skis absorb the increasing pressure of the turn) along with a bending of the body the required radius or arc of the turn can be maintained.

The difficulty in this is that towards the end of the turn the skier finds himself leaning back more and more. To help overcome this a stiff forward angled high ski boot has been developed which can act as a lever to pressure the tail of the skis without leaning back so far. It has been noted that most skiers from beginners to experts even when the assistance of the boot find themselves leaning too far back towards the end of a turn. The stored energy in the tail of the ski then releases the energy by returning to its previous shape thereby creating an upward push to the skier. This upward push helps with releasing the weight in preparation for the next turn.

However the leaning back towards the end of the turn, combined with the forces of gravity (the angle depending on the steepness of the ski slope) and the angular forces created by the turn make it difficult for the skier to regain a balanced slightly forward position with which to initiate the following turn.

During the turn the angular forces created act on the skis which can cause them to slide or "wash out", particularly on icy or hard packed snow conditions. Proficient skiers keep their edges of their skis razor sharp to assist them in preventing this from occuring.

It has now been determined that a snow ski, particularly an Alpine ski, where the maximum height (radius of curvature) of the bottom camber is in the rearward portion of the ski behind the centerline of the boot placement, and the waist (minimum width of the side camber) of the ski is ahead of the centerline of the boot placement such that the ski width is increasing at this centerline position, is substantially more controllable in turns on all snow conditions usually encountered on ski slopes.

The combination of these two factors has the following effect on the skier's ability to execute his turns. Substantially more energy can be absorbed and stored by the ski (particularly at the rear) during the turn without seriously affecting the arc or radius of turn desired as there is less pressure applied at the tip of the ski. Correspondingly it is possible to increase the height of the camber and/or stiffness of the ski without causing loss of controllability of the tips during the turn. With the waist forward there is greater contact with the ski slope at the centerline of the boot placement and rearwards.

This coupled with the additional energy stored in the ski reduces the tendency of the ski to slide or "wash out". The increased absorption of energy at the rearward portion of the ski also allows the skier to remain more upright and balanced over his skis. When the skier is completing his turn and the ski returns to its original shape this energy as it is behind the centerline of the boot is applied upwards and forward thereby assisting the skier to be in the proper position to initiate the next turn.

BRIEF DESCRIPTION OF THE DRAWINGS

In drawings which illustrate embodiments of the invention.

Figures 1, 2, 3, 4:
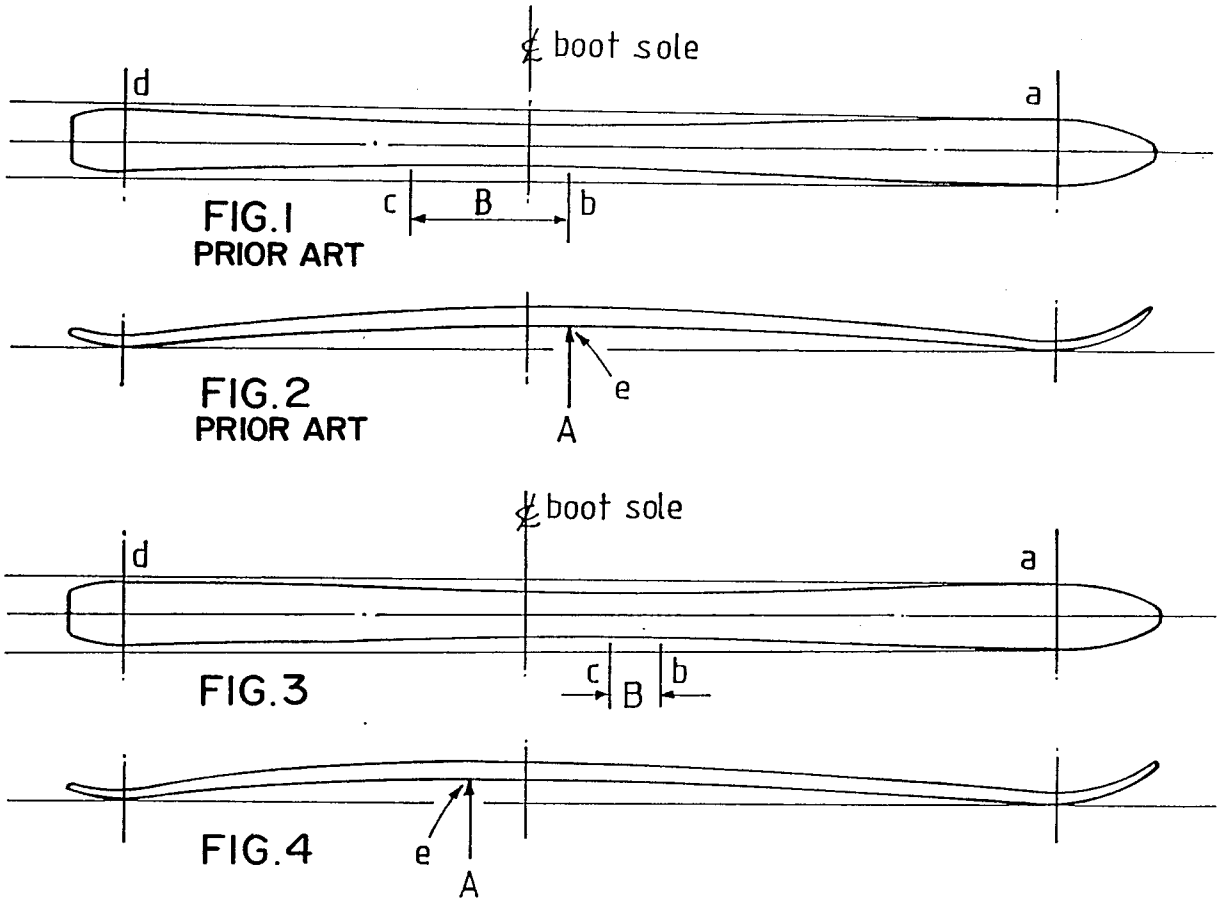
FIG. 1 PRIOR ART
FIG. 2 PRIOR ART
FIG. 1 is a plan view of a conventional ski, known in the art.
FIG. 2 is a side elevation of a conventional ski known in the art.
FIG. 3 is a plan view of a ski according to the preferred embodiment of this invention.
FIG. 4 is a side view of a ski according to the preferred embodiment of this invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENT

In the following description, similar features in the drawings have been given similar reference numerals.

Referring to FIG. 1 which is the plan view of a conventional ski it can be seen that the waist B of the ski is within the area of the centerline c of the boot placement. Referring to FIG. 2 which is the side elevation of a conventional ski it can be seen that the maximum height A of the bottom camber is located approximately at the midpoint of the planar surface where the forward portion of the ski touches that surface and the rearward portion of the ski touches that surface when the ski is placed on that surface.

FIGS. 3 and 4 show the two features of the ski design that when combined result in a ski which is substantially superior in performance and efficiency. FIG. 3 shows the position of the waist B forward of the centerline of the boot placement so that the width of the ski is increasing (rearwards) at this centerline. FIG. 4 shows the maximum height A of the bottom camber behind (rearward) the centerline of the boot placement.

To more clearly illustrate the improved ski of the present invention the following is an example of a ski which would be utilized by a proficient skier in the execution of his sport of slalom skiing.

A comparison is made to a typical prior art slalom ski. It is recognized that these measurements are not fixed and can be varied (and are varied on a prior art ski) depending on many factors such as the length, stiffness and composition of the skis. Measurements involving length use the tail of the ski as the datum.

| | Prior Art Ski FIGS. 1 and 2 | Improved Ski FIGS. 3 and 4 |
|---|---|---|
| Length of Ski | 205.0 cm | 205.0 cm |
| Width at a | 8.8 cm | 8.8 cm |
| Width at b | 6.8 cm | 6.8 cm |
| Width at c | 6.8 cm | 6.8 cm |
| Width at d | 7.8 cm | 8.3 cm |
| Length from tail at a | 190.0 cm | 190.0 cm |
| Length from tail at b | 96.0 cm | 112.0 cm |
| Length from tail at c | 64.0 cm | 102.0 cm |
| Length from tail at d | 7.0 cm | 7.0 cm |
| Length from tail at A | 98.5 cm | 75.0 cm |
| Length from tail at Boot centerline | 85.5 cm | 85.5 cm |
| Height at A | 1.1 cm | 1.8 cm |

The repositioning of the waist B and of the maximum height A of the bottom camber produced a performance which was superior to the conventional ski in field trials.

It was found in arriving at optimum design during field trials of this embodiment of the improved skis that the increased width at d and the increased height at A as compared to the example of the prior art ski gave some improvement of performance.

This specific example of the invention illustrates the best known mode for practicing this invention.

Thus it is apparent that the invention provides an alpine ski that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modficiations and variations as fall within the spirit and broad scope of the invention.

What we claim as our invention:

1. A snow ski having a bottom camber, a side camber, and a single waist, said waist defined as that portion of the ski at which the side camber defines the minimum width of the ski, said ski comprising an overall length of 140 cm. to 230 cm., and wherein the maximum height of the bottom camber is in the rearward portion of the ski behind the centerline of the boot placement and the waist of the ski is wholly ahead of the centerline of boot placement such that the ski width is increasing in the rearward direction of the ski at this centerline position.

2. The ski of claim 1 in which the height of the camber is between 0.3 cm and 2.5 cm.

3. The ski of claim 1 in which the length of the waist is from 0.1 cm to 50 cm.

4. The ski of claim 1 in which the curvature of the camber is a radius of an arcuate curvature.

5. The ski of claim 2 in which the length of the waist is from 0.1 cm to 50 cm.

6. The ski of claim 2 in which the curvature of the camber is a radius of an arcuate curvature.

7. The ski of claim 4 in which the arcuate curvature is a circle or an ellipse.

8. The ski of claim 6 in which the arcuate curvature is a circle or an ellipse.

* * * * *